United States Patent [19]

Bollmann

[11] 4,309,131

[45] Jan. 5, 1982

[54] MINE ROOF SUPPORT

[75] Inventor: Alfred Bollmann, Bochum, Fed. Rep. of Germany

[73] Assignee: Bochumer Eisenhütte Heintzmann GmbH & Co., Bochum, Fed. Rep. of Germany

[21] Appl. No.: 166,697

[22] Filed: Jul. 2, 1980

[30] Foreign Application Priority Data

Jul. 12, 1979 [DE] Fed. Rep. of Germany ..... 2928151

[51] Int. Cl.[3] ..... E21D 15/44

[52] U.S. Cl. ..... 405/294; 405/291

[58] Field of Search ..... 405/291-301; 299/31

[56] References Cited

U.S. PATENT DOCUMENTS 3,143,862 8/1964 Cowlishaw ..... 299/31 X
3,812,681 5/1974 Allen ..... 405/299

FOREIGN PATENT DOCUMENTS 1152377 8/1963 Fed. Rep. of Germany ..... 405/292
941767 11/1963 United Kingdom ..... 405/291
1548724 7/1979 United Kingdom ..... 405/291

*Primary Examiner*—Dennis L. Taylor
*Attorney, Agent, or Firm*—Michael J. Striker

[57] ABSTRACT

A mine roof support has a base, a supporting prop extending upwardly from the base, an elongated roof-supporting element having one portion supported by the supporting prop and another portion telescopable relative to the one portion toward a mine face and having a free end formed as a housing with a width corresponding to the width of the one portion, and a thrust prop arranged to support the free end section of the telescopable portion of the roof-supporting element and having a roof-side end section which is forcedly displaceable in the housing in direction of elongation of a mine and pivotable in a substantially vertical plane about an axle arranged in the housing.

15 Claims, 6 Drawing Figures

A
B
C
D
E
F
1
2
2'
3
4
5
6
7
8
9
10
14
17
18
19
41
42
II
III

FIG. 4
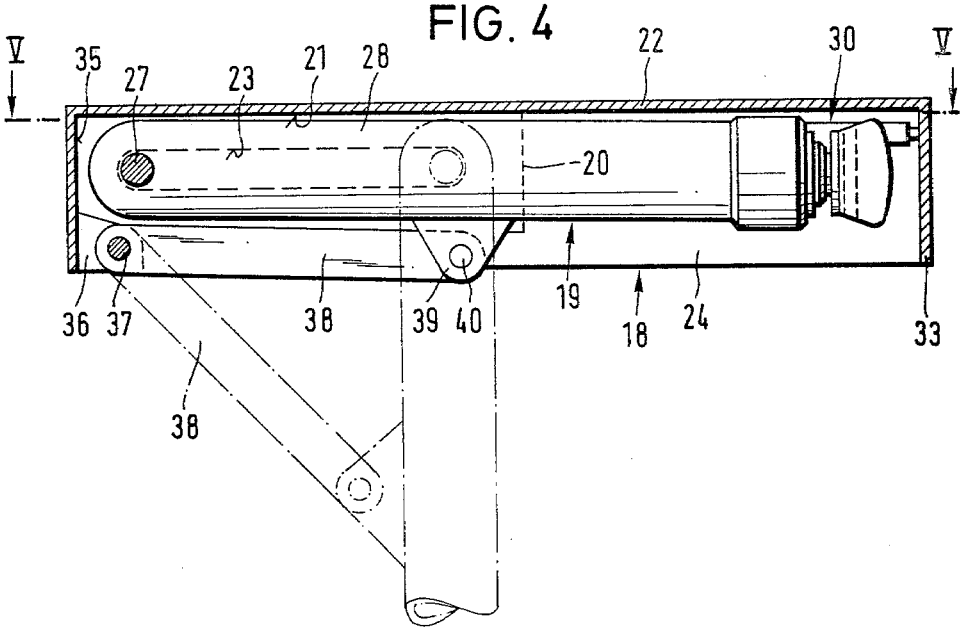
FIG. 5
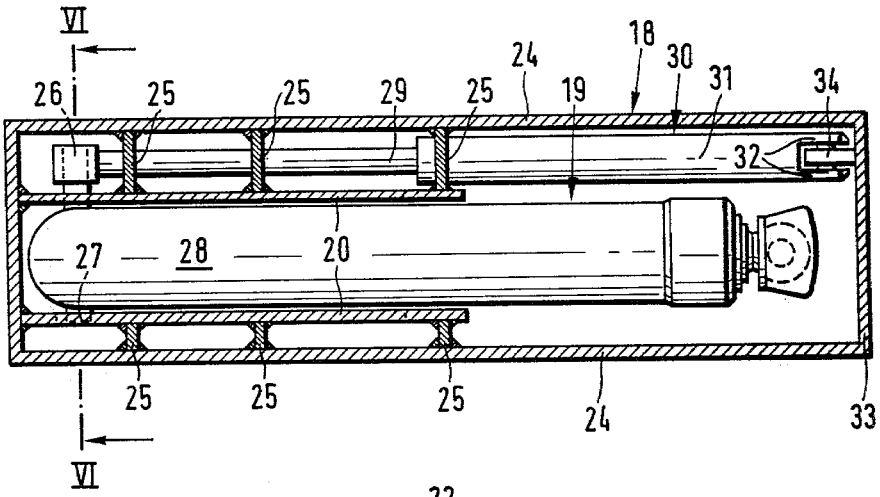
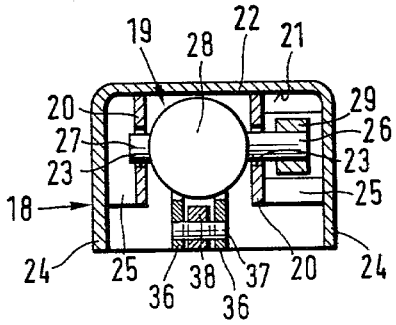
FIG. 6

MINE ROOF SUPPORT

BACKGROUND OF THE INVENTION

The present invention relates to a mine roof support, particularly to a shield mine roof support.

Mine roof supports of the above-mentioned general type are known in the art. A known mine roof support is introduced into a mine gallery and works in the mine face by a mining device which is displaceable in direction of elongation of the mine gallery. The cutting width of the mining device is considerably greater than the cutting depth of a planning tool or a cutting machine. The cutting width may be equal for example to between three meters and 3.5 meters. The cutting tool is composed of an elongated one-part or multi-part roller-shaped material removing drum with an approximately horizontal axis of rotation. The material removing drum is arranged at an end face of the machine body of the mining device and is raisable and lowerable in the vertical plane. The removed mineral is conveyed via an intermediate conveyor provided on the mining device, onto a gallery conveyor which is displaceable along the mine face and delivers the mineral to a conveyor provided in the subsidiary gallery.

The mining device has the considerable cutting width and thereby great freely lying roof areas take place and special mining processes must be utilized. In this condition, it is necessary to support by an additional thrust prop the mine face end of the roof-supporting element of the mine roof support extending from the travel field to the mining field, before and after the passage of the mining device. In connection with this, individual props are known which can be displaced by hand and installed, after the passage of the mining device, under the free end of the displaced rood-supporting element, particularly under the projecting longitudinal portion of the roof supporting element.

It is also known to arrange the thrust prop directly in the roof supporting element and to pivot the same in the plane of the roof-supporting element. This pivoting is performed, as a rule, in longitudinal direction of the roof supporting element, inasmuch as here the space is available for accommodating the thrust prop. Thrust props are also known in the art which can be pivoted in a plane which is parallel to the mine face. They are, however, utilized only in the case when the respective deposits have a relatively small thickness. The thrust prop which is centrally articulated on the roof supporting element can, because it is short, always be pivoted in the plane of the roof supporting element, so that when the thrust prop is extended it assumes a supporting position in which it lies substantially in the vertical central longitudinal plane of the mine roof support. These possibilities are, however, limited inasmuch as in condition of increasing deposit thicknesses the lengths of the props also increase and the telescopable props can no longer guarantee the central momentum-free support of the mine face end of the roof supporting element and to provide for pivoting of the prop in the plane of the roof supporting element. The minimum length of such a prop considerably exceeds the half width of the roof supporting element in the region of the mine face. An off-central connection results in high torsion moment in the roof-supporting element.

SUMMARY OF THE INVENTION

Accordingly, it is an object of the present invention to provide a mine roof support which avoids the diadvantages of the prior art.

More particularly, it is an object of the present invention to provide a mine roof support in which, regardless of the deposit thickness, the thrust prop can pivot in longitudinal direction of the mine gallery in the plane of the roof supporting element, and during pivoting out of this plane, assumes a position which lies substantially in the vertical central longitudinal plane of the mine roof support.

In keeping with these objects and with others which will become apparent hereinafter, one feature of the present invention resides, briefly stated, in a mine roof support in which a roof supporting element has at least a free end section which is formed as a housing with a width in direction of elongation of a mine, substantially corresponding to the width of a portion supported by a supporting prop, and a roof side end section of a thrust prop is forcedly displaceable in the housing in direction of elongation of a mine and pivotable in a substantially vertical plane about an axle arranged in the housing.

When the mine roof support is designed in accordance with the present invention, the free end portion of the telescopable part of the roof supporting element is so formed that it supports the roof of the mine over a great area. It also can be maintained that the backfilling longitudinal portion of the roof supporting element has the same or a similar width. Furthermore, the free end of the roof-supporting element is formed as a housing. The housing serves for accommodating of the thrust prop, and a decisive criterion is that the roof side end section of the thrust prop is displaceable in the housing in direction of mine elongation. Thereby the prop can be displaced from its supporting position in the vertical central longitudinal plane of the mine roof support to the approximately horizontal inoperative position into an end section of the housing, in dependence upon the longitudinal direction of the mine or gallery. Thereby, the entire length of the housing is available for accommodation of the thrust prop. The correspondence of the housing parallel to the mine face to the width of the roof-supporting element in the region of the supporting prop means that also in condition of greater deposit thicknesses the thrust prop can be unobjectionably retracted in the housing and then again extended in the vertical central longitudinal plane of the mine roof support for torsion-free and momentum-free support of the free mine face end section of the roof-supporting element. It is also essential that the pivot axis of the thrust prop is arranged at the end of the housing. A connecting member is articulately connected with the thrust prop, on the one hand, and with the pivot axle, on the other hand. Thereby, the thrust prop displaces over a predetermined stroke from the approximately horizontal position in the casing to the approximately vertical supporting position in the central longitudinal plane of the mine roof support, and vice versa.

Another advantageous feature of the present invention is that the thrust prop is connected with the pivot axle via a length-invariable link. In this case, the above-mentioned connecting member is formed by this link. The point of articulation of the link on the thrust prop moves during displacement of the thrust prop always over a circular arc with a predetermined vertical stroke.

Even though it is possible in principle that the connecting-rod-end section of the thrust prop can be connected with the roof supporting element, it is advantageous in accordance with still another feature of the present invention, when the thrust prop is forcedly guided with the free end of its cylinder, in the housing. Thereby, the part of the thrust prop which possesses higher strength can be provided with means for forced guidance in the housing.

In connection with this, a further feature of the present invention is that the end section of the thrust prop which is forcedly displaced in the housing has two pivot pins which are located diametrically opposite relative to the longitudinal axis of the prop. The pivot pins engage in longitudinal guide elements in the housing, in sliding relationship. It is advantageous when the longitudinal guide means are formed by elongated groove-like recesses provided in two plates which are mounted in the housing. Thereby, relatively simple means form a system of forced movement which corresponds to mining conditions, and is sturdy and service free as well as can take up great twisting and torsion forces.

Even though the plates can be integrated in various ways in the housing, a further advantageous feature of the present invention is that the plates extend over half of the length of the housing and are welded on the lower face of the roof-supporting plate and connected to the side walls of the housing by reinforcing elements.

The pivotal movement of the thrust prop is performed in accordance with still a further feature of the present invention by a longitudinally extending cylinder-and-piston unit arranged in the housing. The cylinder-and-piston unit is hydraulically actuated and lies in protected manner inside the housing. Thereby, the influence of the rough conditions in mines is eliminated.

In connection with this, it is further advantageous when the cylinder of the cylinder-and-piston unit is pivotally connected with the housing and the piston rod is articulately connected with one of the above-mentioned pivot pins. The arrangement and mounting of the thrust prop and the cylinder-and-piston unit in accordance with a concomitant feature of the present invention may be so selected that in retracted position of the thrust prop and the cylinder-and-piston unit they are located substantially parallel and adjacent to one another.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 4 is an enlarged view showing a vertical longitudinal section of a mine face-side end portion of a roof-supporting element of a shield mine roof support of FIGS. 2 and 3 taken along the line IV—IV in FIG. 2;

FIG. 5 is a view showing a horizontal section taken along the line V—V in FIG. 4; and FIG. 6 is a view showing a vertical section taken along the line VI—VI of FIG. 5.

DESCRIPTION OF A PREFERRED EMBODIMENT

Figure 1:
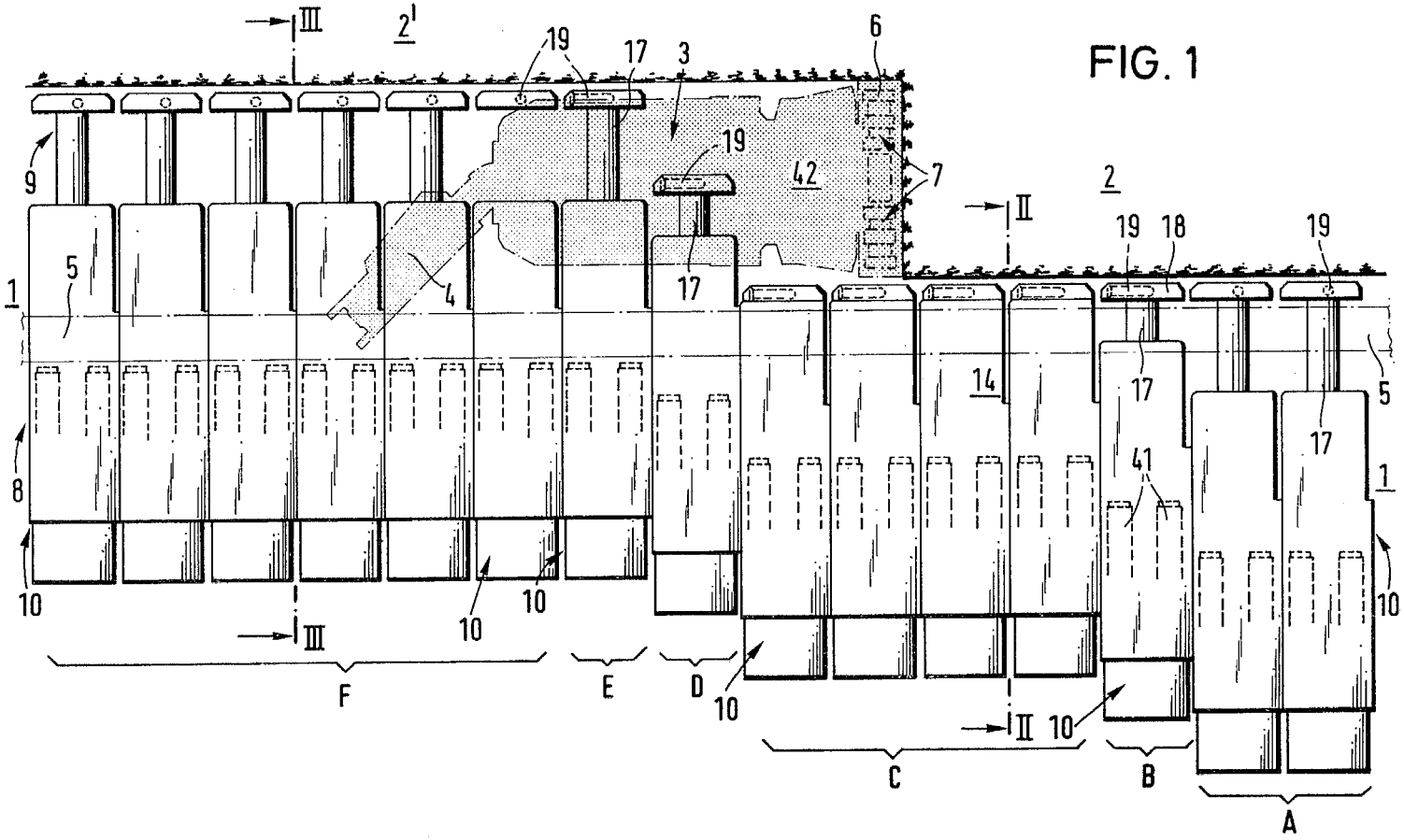
FIG. 1 is a view showing a horizontal longitudinal section of a mine gallery supported by a mine roof support with a schematically shown mining device.

FIG. 1 shows a mine gallery 1 in which a mining device 3 moves in longitudinal direction of the gallery 1 and works in mineral of a mine face 2. The mineral is conveyed via an intermediate conveyor 4 onto a continuous conveyor 5 displaceable along the mine face 2. The continuous conveyor 5 conveys the mine row to a not shown gallery conveyor. The mining device 3 is self-propelling and not forcibly displaceable. It is provided at its end face with a material-removing drum 7 which rotates about a horizontal axis 6. The material-removing drum 7 is raisable and lowerable in vertical direction. The cutting width of the material-removing drum 7 and the thereby attained coal excavation depth considerably exceeds the cutting depth of a coal planning tool or a cutting machine which reciprocates along the mine face. The coal excavation depth amounts to substantially between 3 meters and 3.5 meters.

The gallery space, i.e., the travel and conveyance field 8 and the mining field 9 over which the coal is removed by the mining device 3, is supported by shield mine roof supports which are located adjacent to each other in longitudinal direction of the gallery.

Each mine roof support 10 has a sole sliding device 11 which serves as a support for a guide arrangement 12. With the aid of the guide arrangement 12 the conveyor 5 can be displaced in correspondence with the progress of the mine face, and respectively the shield mine roof support 10 operates with support against the conveyor 5. Supporting props 13 are arranged on the sole sliding device 11 and articulately support a roof-supporting element or cap 14. A backfilling end portion of the roof-supporting element 14 is provided with an articulately connected inclinable breakage shield 15. The latter is connected via a double swinging structure 16 with the backfilling end section of the sole sliding device 11.

Figure 2:
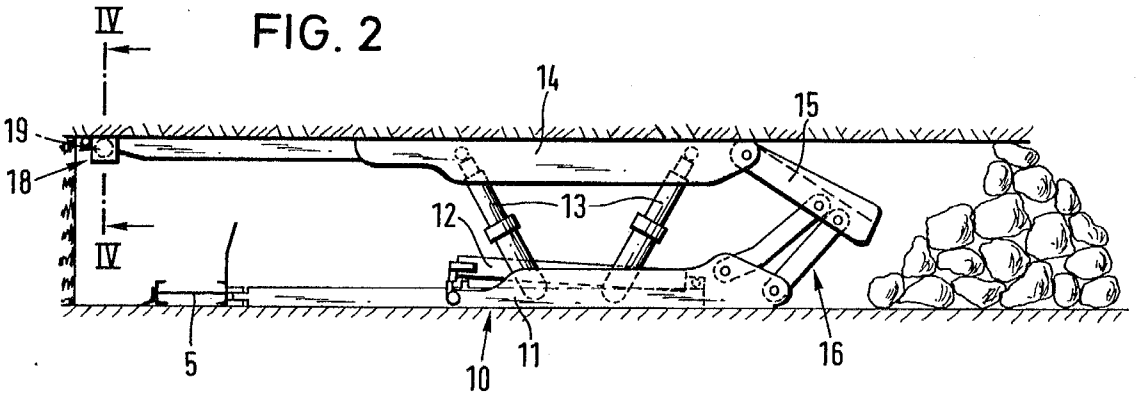
FIG. 2 is a view showing a vertical section of the mine gallery of FIG. 1 with a shield mine roof support in side view in an operative position, taken along the line II—II.
Figure 3:
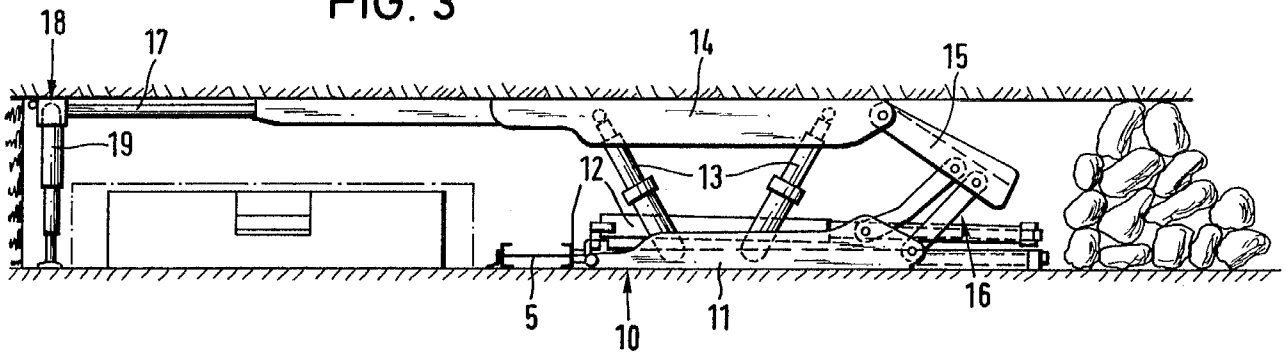
FIG. 3 is a view showing a vertical section of the mine gallery of FIG. 1 with a shield mine roof support in side view in a further operating position, taken along the line III—III.

As can be seen from joint consideration of the FIGS. 2 and 3, the roof-supporting element 14 is telescopable and has a projecting longitudinal portion 17 with an end section 18 formed as a housing for receiving and bearing a thrust prop 19.

As can be seen further from FIGS. 4 and 6, the housing-shaped end section 18 of the telescopable longitudinal portion 17 has two vertical members or plates 20 which are welded on a lower face 21 of a roof-supporting plate 22 and extends in longitudinal direction. In the central region as considered in vertical direction, the members 20 have elongated groove-shaped recesses 23. The members 20 are fixedly mounted by transverse reinforcing members 25 to side walls 24 of the housing 18. The housing 18 has a width corresponding to the width of the roof-supporting element 14 in the region of the supporting props 13.

Two pivot pins 26 and 27 slide tightly in the recess 23. The pivot pins 26 and 27 are mounted laterally on a cylinder 28 of a hydraulically actuated telescopable thrust prop 19. The diameter of the cylinder 28 is only insignificantly smaller than the inner distance between the vertical members 20.

The pivot pin 26 is longer than the pivot pin 27. A hydraulically actuated cylinder-and-piston unit 30 are located in the housing 18 parallel to the longitudinal recesses 23 and pivotally connected to the end of the pivot pin 26 of a piston rod 29. The cylinder 31 of the cylinder-and-piston unit 30 is pivotally connected with a web 34 extending from a side wall 33 of the housing 18, via a fork-shaped end portion 32.

FIGS. 4 and 6 further show that a fork web 36 with a transverse pin 37 is provided on an inner side 35 of the other side wall of the housing 18. A longitudinally invariable link 38 engages with the transverse pin 37 and, on the other hand, engages between two shackles 39 mounted on the periphery of the cylinder 28 of the thrust prop 19. The connection is attained via a pivot pin 40.

A retracted position of the thrust prop 19 is shown in FIGS. 4–6 in full lines. The cylinder-and-piston unit 30 is in its extended position. When the annular space of the cylinder-and-piston unit 30 is actuated, the piston rod 29 moves and displaces the pivot pins 26 and 27 in the longitudinal recesses 23 of the members 20. Simultaneously, the thrust prop 19 moves downwardly of its connection with the pivot axis formed by the transverse pin 37, via the link 38. Thereby, the pivot axle 40 between the link 38 and the cylinder 29 describes a semicircular arc. The length of the link 38 and the length of the groove-shaped longitudinal recesses 23 are so dimensioned that when the cylinder-and-piston unit 30 is completely retracted, the thrust prop 19 assumes an upright position in which it is located substantially in a vertical central longitudinal plane of the shield mine roof support 10 (as shown in dotted line in FIG. 4).

In an initial position A in accordance with FIG. 1, the shield mine roof supports 10 are installed and the extended projecting portions 17 are supported at their free end by additional thrust props 19 installed between the conveyor 5 and the mine face 2.

When the mining device 3 approaches, the thrust prop 19 is retracted into the housing 18 at the free end of the projecting portion 17, and the shield mine roof support 10 is advanced to a predetermined extent in direction toward the mine face 2. This can be performed, for example, by simultaneous actuation of the piston and annular spaces of the cylinder-and-piston unit 41 of the guiding arrangement 12, as well as a not shown cylinder-and-piston unit provided in the roof-supporting element 14.

When the mining device 3 further approaches, the shield mine roof supports 10 are further advanced until their roof-supporting element 14 lie directly against the mine roof support 2. This position is the position C in FIG. 1.

The shield mine roof supports 10 retain this position during passage of the mining device 3 so long until the material removing drum 7 with its pivoting arrangement 42 passes the respective shield mine roof support 10.

In this situation, in accordance with position D, the entire shield mine roof support 10 is advanced in direction toward a new mine face 2' which is displaced by the distance corresponding to the cutting width of the material removing drum 7. The projecting portion 17 with the thrust prop 19 held in retracted position extends relative to the field mine roof support 10. To the moment when the rear end of the mining device 3 passes the field mine roof support 10, the mine support 10 in correspondence with position E is completely drawn to the conveyor 5 and the projecting portion 17 is extended relative to field mine roof support 10 up to the mine face 2'. As soon as the mining device 3 passes the pivoting region of the thrust prop 19, the latter is hinged out to a supporting position shown as F, so that now both the travel and conveyance field 8 and also the excavated mining field 9 can be unobjectionably supported by the mine roof supports 10.

The mine roof supports 10 retain this position until the mining device 3 reaches the gallery end and in the escavated mining field 9 below the shield mine roof supports is returned to the initial position. Thereafter, the guiding arrangement 12 of the conveyor 5 is displaced to the new mine face 2' by the respective actuation of the cylinder-and-piston unit 41 until it reaches a location corresponding to the position D.

It will be understood that each of the elements described above, or two or more together, may also find a useful application in other types of constructions differing from the types described above.

While the invention has been illustrated and described as embodied in a mine roof support, it is not intended to be limitedto the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A mine roof support, comprising a base; a supporting prop extending upwardly from said base; an elongated roof-supporting element having one longitudinal portion which is supported on said base by said supporting prop and has a predetermined width, said roof-supporting element having another longitudinal portion which is telescopable relative to said one portion toward a mine face, said telescopable portion of said roof-supporting element having at least a free end section which is formed as a housing having a width, in direction of elongation of a mine, substantially corresponding to the width of said one portion supported by said supporting prop; and a thrust prop arranged to support said free end section of said telescopable portion of said roof-supporting element, said thrust prop having a roof-side end section which is forcedly displaceable in said housing in direction of elongation of a mine and pivotable in a substantially vertical plane about an axle arranged in said housing.

2. A mine roof support as defined in claim 1, wherein said housing has an end section, said axle being arranged in said end section of said housing.

3. A mine roof support as defined in claim 1, wherein said thrust prop is connected with said axle by a length-invariable guide link.

4. A mine roof support as defined in claim 3, wherein said roof-side end section of said thrust prop has a roof-side end, said guide member being elongated and having two end sections spaced from one another in the direction of elongation, one of said end sections of said guide link being pivotally connected with said axle, whereas the other of said end sections of said guide link is pivotally connected with said thrust prop at a location spaced from said roof-side end of said prop.

5. A mine roof support as defined in claim 1, wherein said thrust prop has a cylinder with a free end section which forms said roof-side end section of said thrust prop and is forcedly displaceable in said housing.

6. A mine roof support as defined in claim 1, wherein said housing has elongated guiding means, said thrust prop having an axis and its roof-side end section being provided with two pivot pins which are arranged at opposite sides of said axis and slidingly engage with said guiding means.

7. A mine roof support as defined in claim 6, wherein said elongated guiding means is formed by two elongated members mounted in said housing and provided with elongated groove-like recesses in which said pivot pins of said thrust prop slidingly engage.

8. A mine roof support as defined in claim 7, wherein said housing has a predetermined length, said guide members extending over one half of the length of said housing.

9. A mine roof support as defined in claim 7, wherein said housing has an upper roof-supporting plate and two side walls, said guide member being arranged at a lower surface of said roof-supporting plate and being connected to said roof-supporting plate and to said side walls.

10. A mine roof support as defined in claim 9, wherein said guide members are welded to said roof-supporting plate of said housing.

11. A mine roof support as defined in claim 9, wherein said guide members are connected to said side walls of said housing.

12. A mine roof support as defined in claim 1; and further comprising a cylinder-and-piston unit accommodated in said housing and operative for pivoting of said thrust prop about said axle.

13. A mine roof support as defined in claim 12, wherein said cylinder-and-piston unit has a cylinder which is pivotally connected with said housing, and a piston with a piston rod which is pivotally connected with said thrust prop.

14. A mine roof support as defined in claim 13, wherein said housing has elongated guiding means, said thrust prop having an axis and its roof-end section being provided with two pivot pins which are arranged at opposite sides of said axis and slidingly engage with said guiding means, said piston rod of said cylinder-and-piston unit being pivotally connected with one of said pivot pins of said thrust prop.

15. A mine roof support as defined in claim 12, wherein said thrust prop and said cylinder-and-piston unit are movable between extended and retracted positions, said thrust prop and said cylinder-and-piston unit being located substantially parallel and adjacent to one another in their retracted positions.

* * * * *